United States Patent [19]

Galloway et al.

[11] 4,190,732

[45] Feb. 26, 1980

[54] ELECTRICAL APPARATUS

[75] Inventors: Dudley L. Galloway; Robert E. Donoghue, both of Jefferson Township, Cole County, Mo.

[73] Assignee: Westinghouse Electric Corp., Pittsburgh, Pa.

[21] Appl. No.: 831,461

[22] Filed: Sep. 8, 1977

[51] Int. Cl.[2] ..... H01F 27/02

[52] U.S. Cl. ..... 174/17 LF; 174/50; 220/67; 220/85 TC; 336/94

[58] Field of Search ..... 174/17 LF, 50, 52 R, 174/52 S; 336/90, 94, 96; 220/85 TC, DIG. 29, 67, 70

[56] References Cited

U.S. PATENT DOCUMENTS

| | | | |
|---|---|---|---|
| 61,356 | 1/1867 | Pfeifer | 220/70 |
| 299,779 | 6/1884 | Haberman | 220/70 |
| 713,901 | 11/1902 | Moody | 220/67 X |
| 2,166,830 | 7/1939 | Thorson | 220/67 X |
| 2,388,524 | 11/1945 | Clark | 336/94 |
| 2,405,853 | 8/1946 | Rosch | 336/94 X |
| 3,482,108 | 12/1969 | Steinmayer | 336/94 X |
| 3,931,027 | 1/1976 | Sadler | 336/94 X |

FOREIGN PATENT DOCUMENTS

| | | | |
|---|---|---|---|
| 1370267 | 7/1964 | France | 336/94 |

*Primary Examiner*—Bruce A. Reynolds
*Assistant Examiner*—D. A. Tone
*Attorney, Agent, or Firm*—D. R. Lackey

[57] ABSTRACT

Fluid-filled electrical apparatus suitable for use in harsh environments. The electrical apparatus includes a tank having bottom and side members whose configuration provides corrosion protection for the electrical apparatus. A plurality of radially spaced, annular shoulders in the bottom member, with flanges therebetween, define a configuration wherein the innermost circular-shaped portion of the bottom member fits with the cylindrical side member with the lower edge of the side member disposed in proximity to one of the flanges in the bottom member to form a joint suitable for welding. The outwardmost flange of the bottom member extends downward from the joint and beyond the side member to provide an edge or rim upon which the entire tank rests and, further, presents sacrificial metal to the environment which protects the joint despite corrosion of the outermost flange.

5 Claims, 5 Drawing Figures

ELECTRICAL APPARATUS

BACKGROUND OF THE INVENTION

1. Field of the Invention

This invention relates, in general, to electrical apparatus and, more specifically, to fluid-filled tank structures for electrical apparatus.

2. Description of the Prior Art

Corrosion problems associated with the tanks of electrical apparatus seriously limit the useful life of such apparatus. In certain electrical apparatus, such as distribution transformers, this problem is aggravated due to the thinner materials of which the distribution transformer tanks are formed and, also, due to the highly corrosive environment such apparatus are placed in, such as those disposed in underground vaults or buried directly in the earth. The tanks of such apparatus must not only seal tightly to prevent leakage of the cooling medium and to keep water and other foreign materials out of the tank; but also must support the weight of the core and coil assembly and the cooling medium during shipping, handling and installation and withstand the dynamic forces exerted by the components of the transformer itself during its operation.

The conventional approach to corrosion prevention consists of coating the exterior tank surfaces with specially formulated coating materials. Protective coatings, however, are only as good as the uniformity of the coating with any pinholes or scratches in the coating, such as those due to shipping, handling and installation, causing rapid corrosion at these areas. Once the coating is damaged, corrosion is further promoted in certain areas, such as at the rim, by water dripping from the lowest extremity thereof.

The configuration of the joint or connection between the cylindrical side wall and the flat bottom members of the tank may also promote or be susceptible to corrosion. Certain prior art configurations, such as those having the joint located at the lowest extremity of the tank or those having the edge of the bottom member bent around the outer surface of the side wall and joined thereto, as shown in U.S. Pat. Nos. 1,699,434 and 3,907,152, are especially susceptible to early corrosion failure since the joint is located at the lowest extremity of the tank rim and thereby subject to the full force of the corrosive effects described above.

Thus, it would be desirable to provide a tank for a fluid-filled electrical apparatus that provides improved corrosion protection therefor. It would also be desirable to provide a substantially leakproof joint construction between the side and bottom members of a tank that easily accommodates the necessary welding or other joining technique to complete the joint and at the same time simplifies the necessary cleaning and finishing of the joint area. Finally, it would be desirable to provide a joint construction that provides easy assembly of the tank by tending to center the bottom member within the side wall member and, also, to constrain the side wall member in a cylindrical configuration.

SUMMARY OF THE INVENTION

Herein disclosed is the new and improved fluid-filled electrical apparatus suitable for use in harsh environments. The fluid-filled electrical apparatus includes the tank formed of a horizontally disposed, circular-shaped bottom member having first, second and third annular, radially spaced shoulders which define first, second and third flange portions and an innermost circular-shaped portion which fits within a cylindrical side member. The second and third shoulders and the second flange therebetween define a lip or shelf in registry therewith. The lower edge of the side member is disposed to form a joint wherein suitable joining means are interposed to securely hold the side and bottom members together in fluid tight relationship. The aforementioned construction not only provides a suitable joint that simplifies the joining of the side and bottom members together, but also, enables the necessary cleaning and inspecting of the joint area to be easily accomplished since the joint is located on the outside of the tank. Furthermore, the configuration of the bottom member is such that it is automatically centered within the side member thereby assuring a strong joint and, additionally, tends to constrain the side portion to retain its round cross-section throughout the construction of the transformer.

The third or outwardmost flange portion of the bottom member extends downward from the joint area and beyond the lower edge of the side member to form a rim or edge upon which the entire tank rests. The edge of the third flange forms the lowest extremity of the tank and thereby protects the joint from the abrasive effects of shipping and handling which damage the protective coating on the outer surface thereof and tend to promote corrosion in this area. The third flange presents sacrificial metal to the environment which allows the third flange to be corroded a substantial distance without affecting the fluid sealing function of the joint between the bottom and side members.

BRIEF DESCRIPTION OF THE DRAWING

The various features, advantages and other uses of this invention will become more apparent by referring to the following detailed description and drawing in which.

DESCRIPTION OF THE PREFERRED EMBODIMENTS

Figure 1:
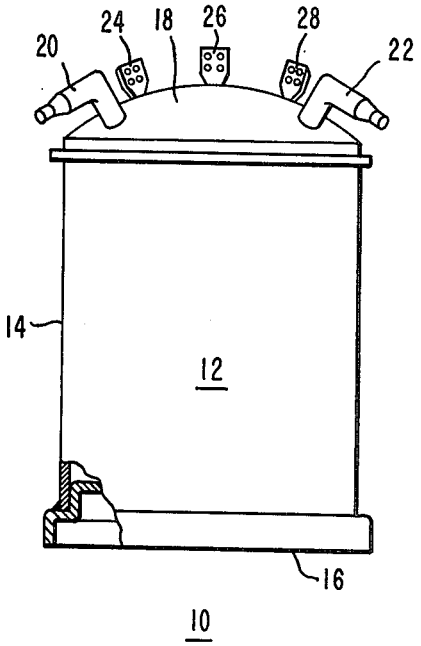
FIG. 1 is an elevational view, partially broken away, of a distribution transformer constructed according to the teachings of this invention.

Throughout the following description, identical reference numbers are used to refer to the same component in all figures of the drawing.

Referring to the drawing, and to FIG. 1 in particular, there is shown an electrical apparatus 10, such as a distribution transformer, constructed according to the teachings of this invention. By way of example and not of limitation, the distribution transformer 10 is of the general type that is mounted on utility poles, disposed underground in specially constructed vaults or buried directly in the earth. The distribution transformer 10 includes a housing 12 which consists of a cylindrical side wall member 14, a bottom member 16 and a cover 18, all concentrically disposed about a vertical axis and joined together in fluid tight relationship. Disposed within the tank 12 is an electric core and coil assembly (not shown) and a quantity of cooling fluid, such as mineral oil, which provides cooling and insulation for the electrical windings of the transformer. The transformer is adapted to be connected to a source of electrical potential through sealed high-voltage bushings 20 and 22 which are connected to the high voltage windings of the transformer. Low-voltage bushings 24, 26 and 28 are provided to connect an electric load to the low-voltage windings of the transformer.

The transformer 10 is subjected to highly corrosive environments, such as, in the case of underground transformers which must withstand flooding of the underground vault with corrosive, polluted water for extended periods of time or, when mounted on a utility pole, must withstand the harsh elements of the environment. Such environments have caused the failure of electrical transformers due to tank corrosion in periods much shorter than their normally expected service life. The conventional approach to corrosion prevention of distribution transformer tanks involves the use of protective coatings on the external tank structures. However, the protective coating is only as good as the uniformity of the coating with any pinholes or scratches in the coating, such as those resulting from shipping and handling, tending to promote rapid corrosion of the tank and resulting in the loss of the cooling fluid therefrom.

One of the primary areas of corrosion in the tanks of distribution transformers is the joint between the cylindrical side wall and the flat bottom members of the tank. Functionally, this joint must seal tightly to prevent the leakage of the cooling fluid from the tank and, also, to keep water and other foreign materials out. In addition, the joint must support the weight of the core and coil assembly and the quantity of cooling fluid disposed within the tank and, also, must withstand the dynamic forces exerted on the tank by components of the transformer itself. Prior art type joint constructions have tended to promote the leakage of the cooling fluid from the tank due to corrosion at or near the joint since such joints have typically been located at the lowest extremity of the tank and are, therefore, susceptible to paint damage during shipping and installation. Once the paint or protective coating is damaged, corrosion is further promoted at the joint by water dripping off the lowest extremity of the tank. In underground distribution transformers, the presence of crevices in the joint, such as those formed in joint constructions having the outer edge of the bottom member bent around the lower edge of the side wall member and joined thereto, results in rapid corrosion of the joint since such transformers are commonly submerged or flooded with water for extended periods of time which traps water in the joint area.

In addition to the functions described above, the configuration of the side wall and bottom members must also accommodate whatever welding is necessary to complete the joint and also to allow for the proper cleaning and finishing of the joint area. Furthermore, the configuration of the side wall and bottom members may also function to center the bottom member within the side wall member and tend to constrain the tank or side wall member. to be round.

Figure 2:
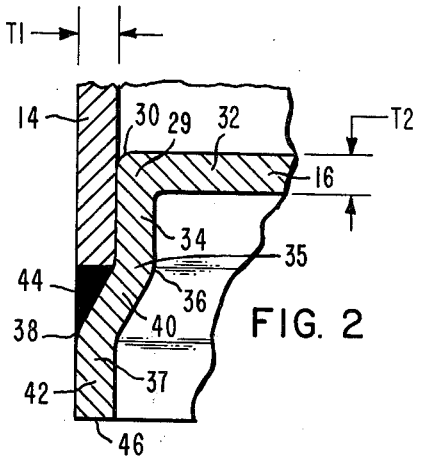
FIG. 2 is an enlarged view of the joint between the side and bottom members of the tank constructed according to the teachings of this invention.

Referring now to FIG. 2, there is shown a partial view of the joint or connection between the side and bottom members of the tank which is constructed according to the teachings of this invention. The side wall 14, which is formed of metallic material having a uniform thickness dimension T1 has a cylindrical shape and is joined to a relatively flat bottom member 16. The bottom member 16, which is formed of metallic material having a uniform thickness dimension T2, includes a first annular bend 29 which defines a first annular, radially spaced, outwardly projecting shoulder 30 which divides the bottom member 16 into an innermost annular flat portion 32 which is disposed within one end of the side member 14 and on which the core and coil assembly of the transformer 10 is mounted and a first axially extending annular flange portion 34. The first shoulder 30 is spaced a predetermined distance from the center of the bottom member 16 such that the circular portion 32 of the bottom member 16 fits snugly within the lower end of the side member 14; at which time the inner surface of the side wall 14 is in close proximity to the end of the first flange portion 34 of the bottom member 16. The bottom member 16 further includes second and third annular bends 35 and 37 which respectively define a second annular inwardly projecting shoulder 36 and a third annular outwardly projecting shoulder 38 disposed between the first shoulder 30 and the outer edge 46 of the bottom member 16. A third downwardly extending annular flange portion 42 extends from the third shoulder 38 to the edge 46 to form a rim on which the transformer 10 rests. A transition or second annular flange portion 40 is disposed between the second shoulder 36 and the third shoulder 38 in the bottom member 16 in angular relation with respect to the first flange 34. At least a portion of the lower edge of the side wall member 14 is disposed in registry to the second flange portion 40 and joined thereto by suitable joining means, such as by weld 44, which joins the side member 14 and the bottom member 16 together in fluid sealing relationship.

The unique configuration of the bottom member 16 described above provides a joint between the bottom member 16 and the side member 14 whose configuration eliminates the corrosion and assembly problems encountered with prior art type joint configurations. The joint 44 between the bottom member 16 and the side wall member 14 is located a substantial distance from the rim or lower edge 46 of the bottom member 16. The lower edge 46 will, accordingly, be subjected to the scraping and chipping experienced during shipping and handling of the transformer 10 whereby the corrosion, resulting from the removal of the protective coating in this area, will affect only the flange portion 42 of the bottom member 16 instead of the joint 44. Thus, the joint 44 will maintain the side wall member 14 and the bottom member 16 in fluid tight relationship despite the corrosion of the flange portion 42 for a substantial distance. In addition, the configuration of the bottom member 16 and the side wall member 14 provides a suitable space therebetween wherein a strong weld bead may be interposed. Since the joint or connection between the bottom member 16 and the side member 14 is on the outside of the tank 12, the joining of the two members together by suitable welding techniques and also the necessary cleaning and finishing of the joint area are greatly simplified. Furthermore, the bottom member 16 is centered within the side wall member 14 by the unique configuration described above which also tends to constrain the side wall member 14 in a round or cylindrical shape throughout the assembly of the transformer.

Figure 3:
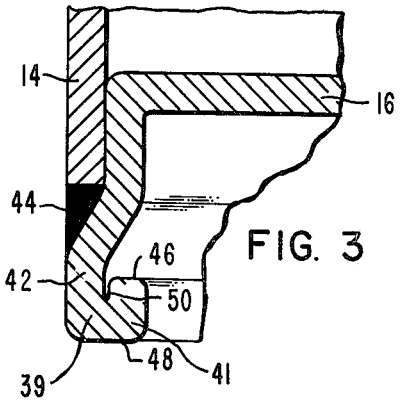
FIG. 3 is another embodiment of the joint shown in FIG. 2.

There is shown in FIG. 3 another embodiment of a joint configuration constructed according to the teachings of this invention. In FIG. 3, the configuration of the bottom member 16 is substantially indentical to that shown in FIG. 2 except that the third flange portion 42 thereof is bent back inwardly on itself via bends 39 and 41 to form another annular flange portion which is disposed in inverted 180° relation axially inward from flange 42 with a lip or rim 48 situated therebetween to provide additional support for the tank 12. The function of the lip or rim 48 as a drip edge is not altered in this configuration; however, it is suggested for use only with pole-mounted distribution transformers since the crevice 50 between the two portions of the third flange 42 would tend to trap water if utilized in a submerged environment thereby hastening the effects of corrosion on the flange 42.

Figure 4:
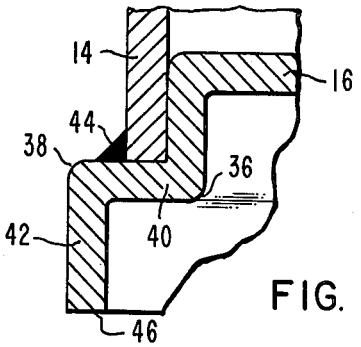
FIG. 4 is another embodiment of the joint configuration shown in FIG. 2.
Figure 5:
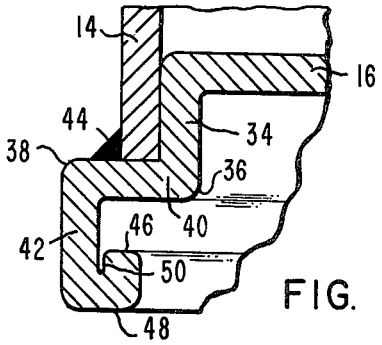
FIG. 5 is another embodiment of the joint shown in FIG. 2.

FIGS. 4 and 5 depict another embodiment of this invention. As shown therein, the second flange portion 40 is horizontally disposed between second and third shoulders, 36 and 38, and is substantially perpendicular to the lower end of the side member 14 to provide a shelf on which the side member 14 rests. The side wall 14 is joined to the second flange portion 40 of the bottom member 16 by suitable joining means, such as weld 44. Otherwise, the use of the third flange portion 42 as sacrificial metal to protect the joint 44 and the ease of joining, cleaning, inspecting and assembling are identical to that described above. In FIG. 5, the third flange portion 42 is bent inwardly on itself to form the rim or edge 48 in a similar manner as that shown in FIG. 3 and, for the reasons discussed with respect to FIG. 3, is suggested for use only with pole-mounted distribution transformers.

Thus, it will be apparent to one skilled in the art that there has been herein disclosed a fluid-filled electrical apparatus having improved corrosion protection which makes it suitable for use in harsh environments. The electrical apparatus includes a tank having a bottom member whose unique configuration provides a joint between the bottom member and the side wall member of the tank that substantially reduces the effects of corrosion in this area of the tank. The outermost flange of the bottom member extends downward from the joint area and beyond the lower edge of the side wall member to form a rim or edge upon which the entire tank rests. Thus, the outermost flange forms the lowest extremity of the tank which protects the joint from the abrasive effects of shipping and handling and, more importantly, presents sacrificial metal to the environment which allows the flange to be corroded a substantial distance without affecting the fluid sealing function of the joint between the bottom and side members of the tank. In addition, the joint formed between the bottom and side wall members is located on the outside of the tank thereby providing a suitable surface for the joining of the two members together which greatly simplifies the construction of the transformer and the necessary cleaning and inspecting of the joint. Furthermore, the unique configuration of the bottom member tends to center the bottom member within the side wall member and also constrains the side wall member to remain in a substantially cylindrical shape throughout the assembly of the transformer.

What is claimed is:

1. Electrical transformer apparatus comprising:

a housing;

a liquid dielectric disposed in said housing;

an electrically conductive element disposed within said housing, in said liquid dielectric, which is adapted for connection to an electrical potential;

said housing including at least a bottom member and a cylindrical side member each formed of metallic sheet material having a uniform thickness, said bottom member and cylindrical side member being concentrically disposed about a vertically extending axis, said side member having first and second ends, said bottom member including first, second and third concentric, annular bends, said first annular bend defining a horizontally oriented circular base portion, and a depending first annular flange portion, said circular base portion being disposed within said side member, adjacent to its second end;

said first annular flange portion extending axially from said circular base portion to said second bend, which is disposed proximate with the second end of said side member;

said second bend providing a second annular flange portion which extends outwardly from said first annular flange portion at a predetermined angle, with at least a portion thereof being disposed below the second end of said side member and further with at least a portion of the second end of said side member being in contact with said second annular flange portion to center said circular base portion of said bottom member within said side member, and to define a joint between said bottom member and said cylindrical side member on the outside of the resulting assembly with respect to the vertically extending axis;

said third annular bend providing a third annular flange portion which extends axially downward from said second annular flange portion and having a lower edge upon which said housing is supported; and joining means disposed to join, and to seal the joint between, said side member and said second annular flange portion of said bottom member, said joining means being a weld bead.

2. The electrical transformer apparatus of claim 1 including a fourth annular bend which defines the lower edge of the third annular flange portion and provides an additional flange portion which extends horizontally inward from the third annular flange portion.

3. The electrical transformer apparatus of claim 1 wherein the second bend is a right angle bend wherein the second annular flange portion of the bottom member is positioned below the second end of the side member, perpendicular with respect to the vertically extending axis, to define a shelf which contacts and supports the second end of the cylindrical side member, with the joining means being disposed between the second annular flange portion and the outer surface of the cylindrical side member.

4. The electrical apparatus of claim 1 wherein the second end of the cylindrical side member includes inner and outer edges with respect to the vertically extending axis, with only the inner edge of the second end being in contact with the angularly extending second annular flange portion, and wherein the joining means is disposed between the second end of the cylindrical side member and the angularly extending second annular flange portion.

5. Electrical transformer apparatus comprising:

a housing;

a dielectric fluid disposed within said housing;

an electrically conductive element disposed within said housing and adapted for connection to an electrical potential;

said housing including at least a bottom member and a cylindrical side member each formed of metallic sheet material having a uniform thickness, said bottom member and cylindrical side member being concentrically disposed about a vertically extending axis, said side member having first and second ends;

said bottom member including:

a first annular bend defining a circular base portion which is disposed within said side member, adjacent to its second end, and a first annular flange extending axially from said first shoulder to a point proximate with the second end of said cylindrical side member;

a second annular bend, said first annular flange extending to said second annular bend, with said second annular bend defining a second annular flange angularly disposed with respect to said first annular flange, with at least a portion thereof being disposed below the second end of said side member, and further with at least a portion of the second end of said side member being in contact with said second annular flange to center said circular base portion of said bottom member within said side member, to constrain said side member to a circular cross section, and to define a joint between said bottom member and said cylindrical side member on the outside of the resulting assembly with respect to the vertically extending axis;

a third annular bend, said second annular flange extending to said third annular bend, with said third annular bend defining a third annular flange having a lower edge upon which said housing is supported; and joining means disposed to join, and to seal the joint between said side member and said second annular flange of said bottom member, said joining means being a weld bead.

* * * * *